US008028371B2

(12) United States Patent
Windrich

(10) Patent No.: US 8,028,371 B2
(45) Date of Patent: Oct. 4, 2011

(54) SUCTION DEVICE

(75) Inventor: Wolfgang Windrich, Ichenhausen (DE)

(73) Assignee: Scheppach Fabrikation von Holzbearbeitungsmaschinen GmbH, Ichenhausen (DE)

( * ) Notice: Subject to any disclaimer, the term of this patent is extended or adjusted under 35 U.S.C. 154(b) by 318 days.

(21) Appl. No.: 12/078,501

(22) Filed: Apr. 1, 2008

(65) Prior Publication Data

US 2008/0250600 A1 Oct. 16, 2008

(30) Foreign Application Priority Data

Apr. 13, 2007 (DE) ..... 20 2007 005 361 U

(51) Int. Cl.
*A47L 5/00* (2006.01)
*A47L 9/10* (2006.01)
*A47L 9/20* (2006.01)

(52) U.S. Cl. ..... 15/327.6; 15/327.2; 15/347

(58) Field of Classification Search ..... 15/327.6, 15/327.2, 347

See application file for complete search history.

(56) References Cited

U.S. PATENT DOCUMENTS

| | | | | |
|---|---|---|---|---|
| 2,499,183 | A * | 2/1950 | Fairgrieve | 15/310 |
| 2,707,527 | A * | 5/1955 | Brace | 55/357 |
| 2,713,921 | A * | 7/1955 | Turner | 55/296 |
| 4,569,100 | A * | 2/1986 | Purkapile | 15/327.2 |
| 5,535,500 | A * | 7/1996 | Stephens et al. | 29/453 |
| 6,081,961 | A * | 7/2000 | Wang | 15/327.2 |
| 7,108,028 | B2 * | 9/2006 | Thomas | 144/154.5 |

* cited by examiner

*Primary Examiner* — Bryan R Muller
(74) *Attorney, Agent, or Firm* — Bacon & Thomas, PLLC

(57) ABSTRACT

In a suction device for the intake by suction and/or extraction by suction of chips or dust, comprising a lower part (1) which is preferably provided with rollers (17), a collection container (2) which can be placed on said lower part and an upper part (3) which closes said collection container and has a motor-drivable fan (9) and a filter cartridge (7) which separates said fan from the interior of the collection container (2), an air inlet (4) which opens into the collection container (2) and is provided with a connector (6) and an air outlet (5) which is arranged downstream of the fan (9) being provided, a low transport volume can be achieved in a simple manner as a result of the fact that there is arranged between the lower part (1) and upper part (3) a support means which is configured in the manner of a telescope and with which there is associated a means (14) for receiving the upper end region of the collection container (2), the axial length of which is variable and the base of which can be secured to the lower part (1).

13 Claims, 3 Drawing Sheets

SUCTION DEVICE

FIELD OF THE INVENTION

Figure 1:
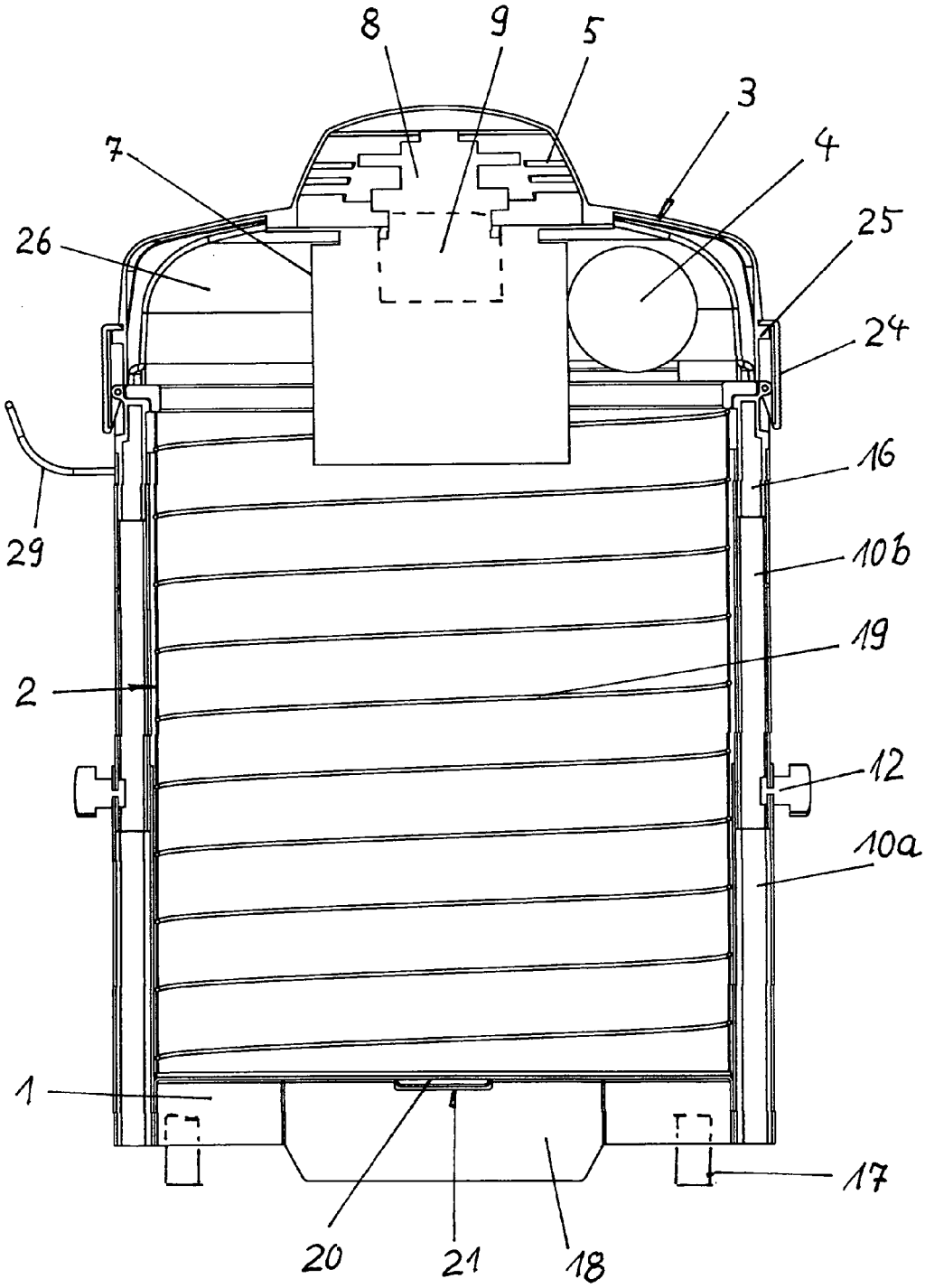

The invention relates to a suction device, in particular a workshop suction device, for the intake by suction and/or extraction by suction of chips and/or dust, comprising a lower part which is preferably provided with rollers, a collection container which can be placed on said lower part and an upper part which closes said collection container and has a motor-drivable fan and a filter cartridge which separates said fan from the interior of the collection container, an air inlet which opens into the collection container and is provided with a connector and an air outlet which is associated with the fan being provided.

BACKGROUND OF THE INVENTION

In the know arrangements of this type, the collection container is configured as a cup-like shaped part. This shaped part is rigid per se and thus defines the height of the device in all cases. This therefore gives rise to a comparatively high transport volume, leading not only to high transportation costs in dispatch but also to comparatively large spatial requirements when the suction device is used in a movable manner. This is detrimental to the overall cost-effectiveness which can be achieved.

Starting herefrom, the object of the present invention is therefore to improve a suction device of the type mentioned at the outset, using simple and cost-effective means and preserving the basic advantages, in such a way that the height of the device is variable.

SUMMARY OF THE INVENTION

According to the invention, this object is achieved in that there is arranged between the lower part and upper part a support means which is configured in the manner of a telescope and with which there is associated a means for receiving the upper end region of the collection container which is collapsible in the axial direction and the base of which can be secured to the lower part.

These measures completely eliminate the above-described drawbacks of the generic prior art. The support means which is configured in the manner of a telescope allows, in conjunction with the height-compressible collection container, a change in the height of the device between the minimum and maximum extension of the telescopic support means. The suction device according to the invention can therefore advantageously be collapsed to a low device height for the purposes of transportation and extended to the maximum device height for use, thus providing a large capacity of the collection container.

Advantageous configurations and expedient developments of the foregoing measures are disclosed in the sub-claims.

The collection container can thus expediently have a circumferential wall which consists of air-tight material, which is movable per se, preferably a plastics material skin, and is put up in the radial direction using a sprading means which is expediently configured as a spiral which is integrated into the wall of the collection container. These measures yield a collection container which has a high capacity and can simply and easily be compressed to a high degree in the axial direction.

Expediently, the lower part can be provided with preferably two opposing tongues which can each be brought into engagement with an associated pocket in the collection container. The base of the collection container is thus secured in a simple and reliable manner.

A further advantageous measure can consist in the fact that the support means preferably has two opposing supports which are formed by T-shaped profiles which engage with one another in the manner of a telescope. These measures impart high flexural strength to the supports and nevertheless allow simple and cost-effective manufacture. The intermeshing parts of the supports can be secured to one another at the desired extension length simply by means of a tensioning screw.

Advantageously, the lower ends of the supports can be inserted or locked in the manner of plug-in pins into associated insertion recesses in the lower part. This allows simple assembly. In an other advantageous development the collection container can be open at the bottom and can be received with its lower edge on an associated mount of the lower part and can be secured thereto by means of a peripheral clip.

Advantageously, the means, which is received on the support means, for receiving the collection container can be configured as an annularly peripheral web to which there are attached plug-in pins which can be inserted or locked into the upper ends of the supports. This also greatly simplifies the assembly of the suction device according to the invention.

In a further development of the foregoing measures, the upper part can be provided with an annular chamber which surrounds the filter cartridge and into which the air inlet opens preferably tangentially. In the transportation state, this annular chamber provides enough space to receive a suction hose which can be attached to a connector associated with the air inlet, thus allowing said suction hose to be stowed in a gentle and space-efficient manner for the purposes of transportation.

Expediently, differing nozzles can be attached to the suction hose. In order to be able to accommodate these nozzles in a clearly visible and reliable manner, the lower part is expediently provided with insertion recesses for a set of nozzles. The lower part is advantageously configured simply as a platform comprising rollers and comprising insertion recesses for the supports and the nozzles and comprising the above-mentioned shackles for supporting the collection container.

Further advantageous configurations and expedient developments of the foregoing measures will emerge from the remaining sub-claims and may also be inferred in greater detail from the following description of an example given with reference to the drawings described hereinafter, in which:

BRIEF DESCRIPTION OF PREFERRED EMBODIMENTS

Figure 2:
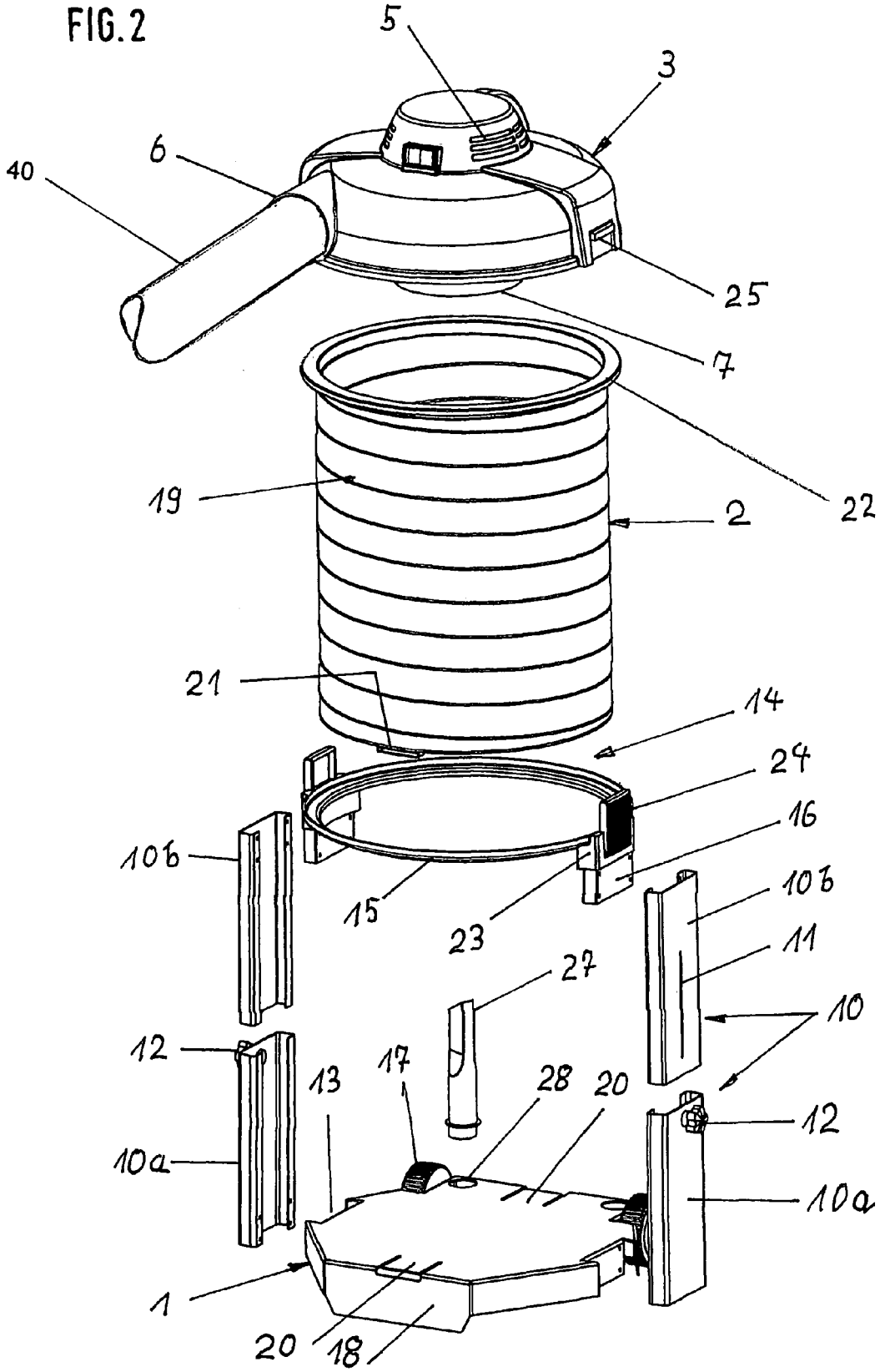
Figure 3:
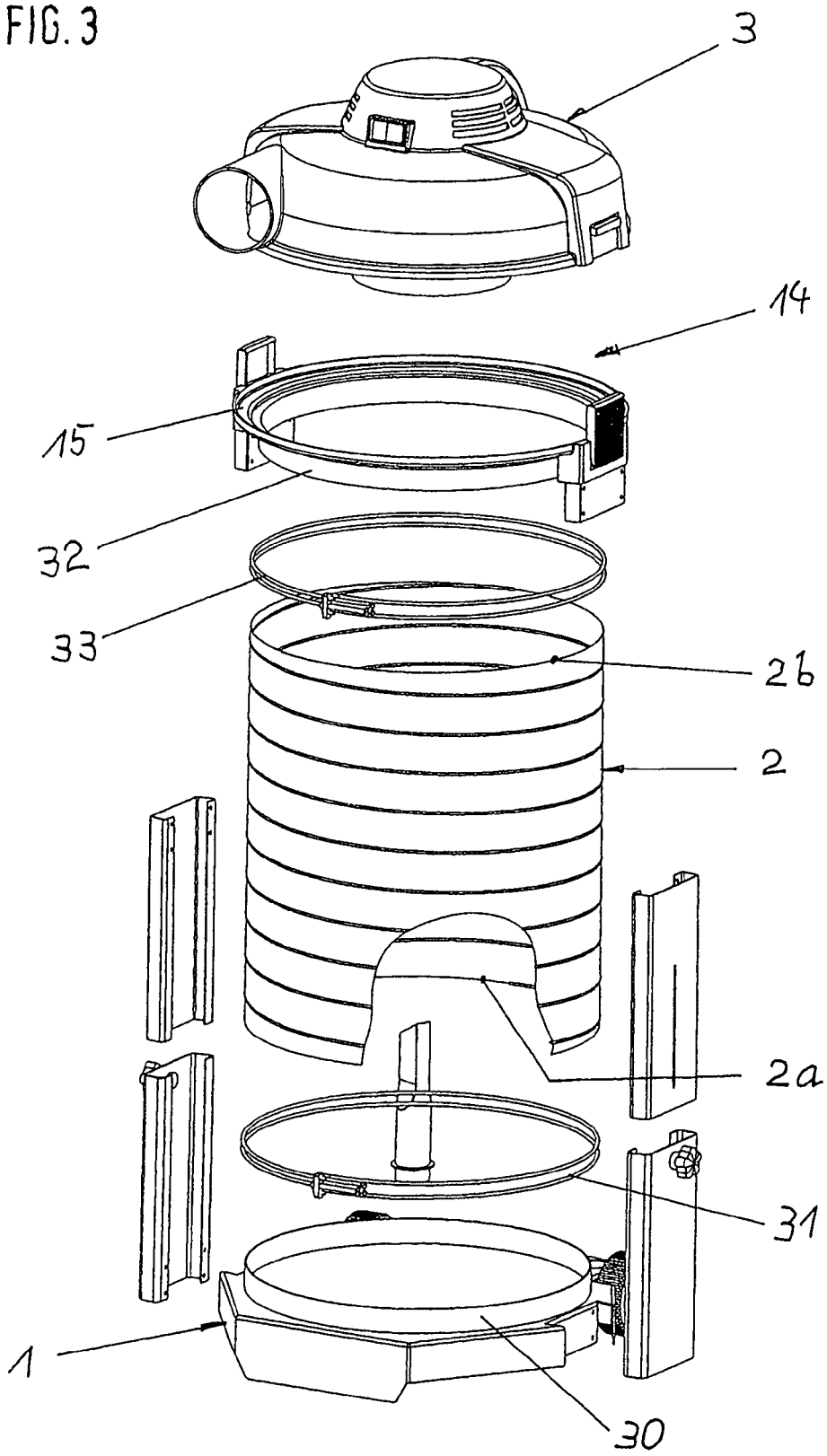

FIG. 1 is a vertical section through a suction device according to the invention, FIG. 2 is an exploded view of the arrangement according to FIG. 1 and FIG. 3 is a view corresponding to FIG. 2 of a further exemplary embodiment of the suction device according to the invention.

The main field of application of the invention is formed by suction devices for professional use such as for workshops and/or building sites and the like.

DESCRIPTION OF PREFERRED EMBODIMENTS

The suction device showed in the Figures contains a lower part 1 which is provided with rollers, a collection container 2 resting on said lower part and an upper part 3 which can be placed onto said collection container from above, is provided with grips and which can be used to close the upper opening in the collection container 2. The suction device has an air inlet 4 which opens into the collection container and an air outlet 5. The air inlet 4 and the air outlet 5 are associated with the upper part 3. The air inlet 4 is provided with an outer connector 6 to which a suction hose (not shown in detail in the present document) can be attached. The air inlet 4 and its associated connector 6 are arranged tangentially in the region of the outer circumference of the upper part 3 which is configured in the manner of a cylindrical cup. The upper part 3 is provided in the region of a central elevation with circumferential-side slots to form the air outlet 5.

The upper part 3 carries a filter cartridge 7 which protrudes into the interior of the collection container 2 and by means of which the interior of the collection container 2 and thus the air inlet 4 which opens into said collection container are separated from the air inlet 5. Located within the filter cartridge 7 is a merely schematically indicated fan 9 which can be driven by means of an electric motor 8, which is also indicated merely schematically, and blows the air drawn in through the filter cartridge 7 out via the air outlet 5.

A support means, which is configured in the manner of a telescope, for the collection container 2, the axial extension of which is variable, is arranged on the lower part 1. The support means contains two opposing supports 10 which each consist of a base part 10*a* which can be secured to the lower part 1 and an extension part 10*b* which interacts with the base part in the manner of a telescope. The base part 10*a* and the extension part 10*b* are configured as C-shaped profiles which can be inserted one within the other, which are more or less telescopic and which can be secured relative to each other in the desired position using a clamping means. In the illustrated example, a tensioning screw 12, which passes through a slot 11 in the extension part 10*b* and onto which a manually tightenable star nut can be screwed, is provided to form the clamping means.

The lower ends of the base parts 10*a* can be inserted in the manner of plug-in pins into a respectively associated, edge-side insertion recess 13 in the lower part 1 and secured therein by locking means or connecting means such as screws, etc. A means 14 for receiving the upper end region of the collection container 2 is provided at the upper end of the supports 10. This receiving means 14 contains a peripheral, flange-like annular web 15 to which there are attached plug-in pins 16 which can be inserted into the upper end regions of the extension parts 10*b* and secured therein, again, by a locking closure or connecting means such as screws, etc. The lower part 1, which receives the support means, is formed by a platform which is provided, on one side, with rollers 17 and, on the other side, with a support 18 which is level therewith.

The collection container 2 is height-adjustable, i.e. collapsible and extendable in the axial direction. In the illustrated example of FIGS. 1 and 2, the collection container 2 is configured as a drum-like bag closed on the bottom and which consists of an air-tight material, which is movable per se, and is spread or put up in the radial direction by a spreading means which is formed by a spiral 19 extending continuously from the lower up to the upper end of said bag. A plastics material skin, which is preferably made of polypropylene, is expediently used to form the wall of the collection container 2. The spiral 19 can advantageously consist of a metal wire which is integrated into the circumferential wall of the collection container 2.

The lower end of the bag building the vertically resilient collection container 2 is secured to the lower part 1 to prevent shortening of the collection container 2 caused by suction draught. For this purpose, the lower part 1 is provided with two opposing holding members 20 which are offset relative to the supports 10, are expediently configured as spring shackles and can be brought into engagement with associated counter-holding members 21, which are configured as insertion pockets and provided on the base, of the bag building the collection container 2. The insertion pockets forming the counter-holding members 21 are expediently arranged on the edge side and connected to the lower end of the spiral 19 which acts as the clamping means. Accordingly, the spring shackles 20 of the lower part 1 are also arranged on the edge side.

In the embodiment of FIG. 1 and at the upper end, the collection container 2 is provided with a peripheral flange 22 which can be placed onto the annular web 15 of the receiving means 14 and pressed thereon by means of the upper part 3. The inside diameter of the annular web 15 corresponds at least to the diameter of the collection container 2 which can be fed through said annular web.

The upper part 3 can be secured, using a tensioning means, to the supports 10 of the support means or to the receiving means 14 received thereon, the flange 22 of the collection container being clamped. In the illustrated example, the plug-in pins 16 emanate from brackets 23 which carry the annular web 15 and are provided with a toggle-lever tensioning means 24, the tensioning clips of which can be brought into engagement with a respectively associated projection 25, protruding on the circumferential side, of the upper part 3.

Obtained inside the upper part, as may be seen most clearly from FIG. 1, is an annular chamber 26 which surrounds the filter cartridge 7 and into which the air inlet 4 opens tangentially. During operation, the annular chamber 26 is not occupied. For the purposes of transportation, the annular chamber 26 is suitable as a chamber for receiving a suction hose 40 which can be attached to the connector 6 and can be accommodated in the receiving chamber in a space-efficient and secure manner.

FIG. 2 shows above the lower part a nozzle 27 which can be attached to the end of the suction hose (not shown in detail) that is remote from the device. Expediently, a plurality of differing nozzles are provided. In the illustrated example, the lower part 1 is provided with insertion recesses 28 for the nozzles of a set of nozzles. The insertion recesses 28 are located in the region of corners, protruding beyond the collection container 2 which has a circular cross section, of the lower part 1 which, viewed from above, is polygonal in its configuration. When not in operation, the suction hose, which is attached to the connector 6, can be introduced into a hook 29 which in this case protrudes from a support 10.

The basic construction of FIG. 3, which will be described hereinafter, corresponds to that of the example described hereinbefore. Only the differences will therefore be mentioned hereinafter, like reference numerals being used as above to denote identical parts.

In the embodiment according to FIG. 3, the collection container 2 is configured, in contrast to the bag used above, as a cylinder which is open at the top and at the bottom and can be received with its lower edge 2*a* on an associated, annular mount 30 of the lower part 1 and can be secured thereto using a peripheral clip 31 provided with a clamping means. A similar fastening is in this case also provided at the upper end of the collection container 2. For this purpose, the receiving means 14 is provided with a mount 32 which protrudes downward from the annular web 15 and on which the drum-like collection container 2 can be received with its upper edge 2*b* and to which the collection container 2 can be secured with its upper edge by means of a peripheral clip 33 which is provided with a clamping means. An embodiment comprising an upper flange similar to the holding flange 22 of the embodiment according to FIG. 2 would, however, also be conceivable. Conversely, in FIG. 2, an upper fastening similar to that of FIG. 3 would also be conceivable.

What is claimed is:

1. A suction device for the intake and/or extraction by suction of chips or dust, comprising:

a lower part;

a collection container which can be placed on said lower part, said collection container having an interior including an upper end region;

an upper part which closes said collection container;

a motor-drivable fan;

a filter cartridge which separates said motor-drivable fan from the interior of said collection container;

an air inlet which opens into said collection container, and is provided with a connector;

an air outlet which is arranged downstream of said motor-drivable fan; and a support arranged between said upper part and said lower part, said support is configured to have upper end supports, an annular ring to which there are attached connecting pins, which can be inserted and locked into said upper end supports, wherein:

said support is telescopically extendable, and said annular ring includes a holder for receiving the upper end region of said collection container, said support having a base which can be secured to said lower part;

the axial length of said upper end region of the collection container being variable;

said support is provided with a mount which protrudes downward from said annular ring and on which the collection container can be received with its upper edge which can be secured to said mount using a peripheral clip;

said lower part is configured as a platform having rollers on one side and, on the other side, has a further support;

said upper part having side projections and the support further having toggle-lever tensioners provided on said annular ring corresponding to said side projections for engagement with said side projections to secure the upper part to the upper ends of said support.

2. The suction device according to claim 1, wherein:

said collection container has a circumferential wall which consists of an air-tight material, which is movable, and can stretch in the radial direction using a spreading structure which is dimensionally stable in this direction.

3. The suction device according to claim 2, wherein:

said spreading structure is configured as a spiral which preferably consists of metal and is integrated into the circumferential wall of the collection container.

4. The suction device according to claim 2, wherein:

said collection container consists of a plastics material skin.

5. The suction device according claim 1, wherein:

said collection container is open at the bottom and can be received with its lower edge on an associated mount of the lower part and can be secured thereto by means of a peripheral clip.

6. The suction device according to claim 1, wherein:

said support base has opposing lower end supports.

7. The suction device according to claim 6, wherein:

each of said upper end supports and said lower end supports are formed by C-shaped profiles which engage with one another, respectively, to telescopically extend relative to one another.

8. The suction device according to claim 6, wherein:

said lower end supports can be inserted and locked into, in the manner of connection pins, into associated insertion recesses in the lower part.

9. The suction device according to claim 1, wherein:

said upper part contains said air inlet which is arranged tangentially relative to said upper part.

10. The suction device according to claim 1, wherein:

said upper part is provided with an annular chamber which surrounds said filter cartridge and into which said air inlet opens.

11. The suction device according to claim 1, wherein:

said air outlet is provided in the form of at least one circumferential-side slot in said upper part.

12. The suction device according to claim 1, wherein:

differing nozzles can be attached to suction hose and said lower part is further provided with insertion recesses for a set of nozzles.

13. The suction device according to claim 3, wherein:

said collection container consists of a plastics material skin.

* * * * *